US005267257A

United States Patent [19]

Jhawar et al.

[11] Patent Number: 5,267,257

[45] Date of Patent: Nov. 30, 1993

[54] VACUUM FURNACE WITH CONVECTION HEATING AND COOLING

[75] Inventors: Suresh C. Jhawar, Chino Hills; John K. Grier, Walnut; Michael T. Mercer, Norco, all of Calif.

[73] Assignee: Grier-Jhawar-Mercer, Inc., Industry, Calif.

[21] Appl. No.: 744,976

[22] Filed: Aug. 14, 1991

[51] Int. Cl.[5] ..... F27D 7/06

[52] U.S. Cl. ..... 373/110; 373/113; 373/130; 373/135; 432/77; 432/205; 432/250

[58] Field of Search ..... 373/110, 113, 130, 112, 373/128, 135, 137; 219/532; 432/77, 83, 185, 202, 205, 152, 176, 250

[56] References Cited

U.S. PATENT DOCUMENTS

| | | | |
|---|---|---|---|
| 3,737,553 | 6/1973 | Kreider et al. | 373/130 |
| 3,798,417 | 3/1974 | Bittner | 219/532 |
| 3,812,276 | 5/1974 | Gyrway et al. | 373/130 |
| 3,860,222 | 1/1975 | Tennenhouse | 266/5 C |
| 4,141,539 | 2/1979 | Bornor | 266/78 |
| 4,233,494 | 11/1980 | Pawlik et al. | 219/382 |
| 4,278,421 | 7/1981 | Limque et al. | 432/152 |
| 4,514,167 | 4/1985 | Royer | 432/11 |
| 4,559,631 | 12/1985 | Moller | 373/130 |
| 4,560,348 | 12/1985 | Moller et al. | 432/77 |
| 4,612,651 | 9/1986 | Moller et al. | 373/130 |
| 4,789,333 | 12/1988 | Hemsath | 432/176 |
| 4,799,881 | 1/1989 | Grier et al. | 432/77 |
| 4,906,182 | 3/1990 | Moller | 432/77 |
| 4,970,372 | 11/1990 | Fleiter et al. | 219/400 |
| 5,035,611 | 7/1991 | Neubecker et al. | 432/176 |
| 5,119,395 | 6/1992 | Hemsath et al. | 373/112 |

OTHER PUBLICATIONS

Application of Vacuum Heat Treatment to Tool and Die Material, James G. Conybear-1988.

High Pressure Quench Vacuum Furnace, Abar Ipsen-1989.

Progress in Design and Use of Vacuum Furnace with High Pressure Gas Quench System, Abar Ipsen-1988.

Industrial Furnace Systems, GM Enterprises.

*Primary Examiner*—Bruce A. Reynolds

*Assistant Examiner*—Tu Hoang

*Attorney, Agent, or Firm*—Christie, Parker & Hale

[57] ABSTRACT

A high temperature vacuum furnace has a circulating path external to the heating chamber for facilitating inert gas circulation during initial convection heating of a high temperature vacuum furnace. The heating chamber of the furnace and a surrounding cooling gas introduction chamber are within a metallic convection shroud in such a way that the space in between defines a heating gas circulation chamber for circulating heated inert gas during low temperature heating for accelerating the heating-up of the hot zone to its normal operating temperatures. Once the hot zone has reached a selected temperature, the inert gas is pumped out and the furnace then operates in a vacuum. Quenching is achieved by introducing cooling gas into the heating chamber via nozzles through the heating chamber walls.

19 Claims, 2 Drawing Sheets

49
61
59
49
47
35
47
35
1
43
55
43
57
51
19
31
33
17
13
27
23
21
29
15
17
23
19
53
37
5
39
7
47
45
49
41
9

VACUUM FURNACE WITH CONVECTION HEATING AND COOLING

BACKGROUND OF THE INVENTION

1. Field of the Invention

This invention relates to construction of an electrically heated vacuum furnace and techniques for accelerating the heating-up of the inside of a heating chamber or hot zone at lower temperatures. More specifically, the invention concerns the creation of a convection circulation chamber external to the hot zone in such a way that both the heating and cooling processes are improved.

2. Description of the Prior Art

Vacuum furnaces have been commonly used in high temperature thermal treatment of materials requiring a high degree of purity. A typical vacuum furnace consists basically of a hermetic furnace housing inside of which is a heating chamber having a plurality of electrical heater elements suitably mounted on its inside walls. During vacuum heating, air in the furnace is evacuated and the load is heated by radiant heat from the heater elements.

Many types of load also require rapid cooling or quenching in order to improve their metallurgical properties. The quenching process, in some cases, can be critical in determining the quality of the final product. A common method for quenching is by subjecting the load in the hot zone to a flow of pressurized cold inert gas introduced into the heating chamber via gas nozzles or orifices through the heating chamber walls. A product brochure entitled "Industrial Furnace Systems" by GM Enterprises illustrates some typical high temperature vacuum furnaces.

A problem with this kind of vacuum furnace is that it takes a relatively long period of time to heat up the hot zone to its high operative temperatures (for example, around 2000° F.). This is because at lower temperatures (below about 1200° F.) radiation is not an efficient method of heat transfer. Convection is, however, by far the more efficient heat transfer mechanism at lower temperatures.

Therefore, in order to accelerate the heating up of the hot zone, some vacuum furnaces are known to have used convection heating followed by evacuation and radiation heating.

U.S. Pat. No. 4,970,372 (Ipsen Industries International) discloses a furnace with a plurality of electrically energized heater elements disposed within a heating chamber. To accelerate the heating up of a load that is disposed within the heating chamber in the lower temperature range, the heater elements have a tubular construction and are provided at their bottom end with an outlet opening. Inert gas conveyed by a fan flows through the heater elements, at which time it is convectively heated, and thereafter passes into the interior of the heating chamber. In the higher temperature range, the heater elements transfer their heat to the load as radiant heat, with the furnace then operating in a vacuum.

This design suffers from several disadvantages: inert gas flow may be impeded by the size of the heater element; the hollow tubular design of the heater elements are more expensive to produce and less durable than the regular solid type.

In another design, disclosed in a product brochure "High Pressure Quench Vacuum Furnaces" by Abar Ipsen, the heating chamber is partitioned by walls to create an annular passage between the heater elements supported from the interior wall of the heating chamber and the principal furnace insulation. A fan mechanism located at one end of the passage forces inert gas circulation between the interior load area and the heating chamber through openings at opposite ends of the passage. During low temperature heating, inert gas is introduced into the heating chamber such that heat transfer from the heater elements to the load occurs mainly by convection. At higher temperature, heat transfer is achieved by radiation with the furnace operating in a vacuum.

This design overcomes some of the drawbacks presented by the previous design with hollow heater tubes but, nevertheless, creates some problems of its own. One of the major problems has to do with the location of cooling gas nozzles. During a rapid cooling cycle (required for many types of load), it is extremely important to maintain uniform cooling of the load in order to achieve uniformity of physical properties and to prevent physical distortion due to unequal rates of contraction of the load. Uniformity of cooling, however, can be achieved only if it is possible to expose the load to the unobstructed flow of cooling gas in all directions. This stringent requirement, therefore, requires maximum flexibility in the location of the cooling gas nozzles with respect to the load under treatment. The presence of the partition walls reduces such flexibility and may adversely affect the ultimate quality of the load under treatment. This design attempts to remedy the drawback by using movable gas nozzles. However, such a design is more costly to implement due to the higher level of engineering complexities in having moving parts which operate in extremely high temperatures.

SUMMARY OF THE INVENTION

To address the shortcomings of the prior art due to the hollow tubular heater elements and the cumbersome partition walls within the heating chamber, the present invention provides a furnace having its heating chamber enclosed by a metallic convection shroud in such a way as to create a heating gas circulation chamber surrounding the heating chamber. At start-up, the hot zone is heated by convection. A fan mechanism effects inert gas circulation between the hot zone and the heating gas circulation chamber, thereby further improving heat transfer efficiency. After the furnace reaches a selected high temperature, the inert gas is evacuated and radiation becomes the main method of transferring heat from the heater elements to the load under treatment.

During a cooling cycle, inert cooling gas is introduced into the hot zone through nozzle openings distributed on the insulation walls of the hot zone between heater elements. An external heat exchanger and blower keep the cooling gas cold and circulating. Air passages are opened by retracting movable bungs to allow warmed cooling gas to exit the convection shroud.

There are clearly several advantages of having the convection shroud on the outside of the heating chamber. During a heating cycle, the convection shroud is exposed to relatively lower temperature than when it is inside the heating chamber, thus enabling the shroud to be made of stainless steel instead of more heat resistant and costly molybdenum or carbon-carbon composite. Also, by having the convection shroud on the outside of the hot zone, it doubles its function as an additional heat shield. Thus, the high temperature thermal insulation requirement of the furnace may be proportionally reduced. All of these design features can result in significant cost savings.

Without the cumbersome partition walls in the way, the location of the cooling gas nozzles can be arranged to provide maximum effectiveness and uniformity in cooling the load under treatment without resorting to a complex high temperature mechanism for swivelling the gas nozzles.

Also during a cooling cycle, undesirable heat transfer between the incoming cold gas and the exiting warmed gas is minimized due to the fact that the heating gas circulating chamber now traps some stagnant gas which acts like a insulation layer separating the incoming cold gas in the cooling gas introduction chamber and the exiting warm gas in the space between the shroud and the furnace shell.

BRIEF DESCRIPTION OF THE DRAWINGS

These and other features and advantages of the present invention will be apparent rom the following detailed description when considered in connection with the accompanying drawings wherein.

DESCRIPTION OF THE PREFERRED EMBODIMENT

Figure 1:
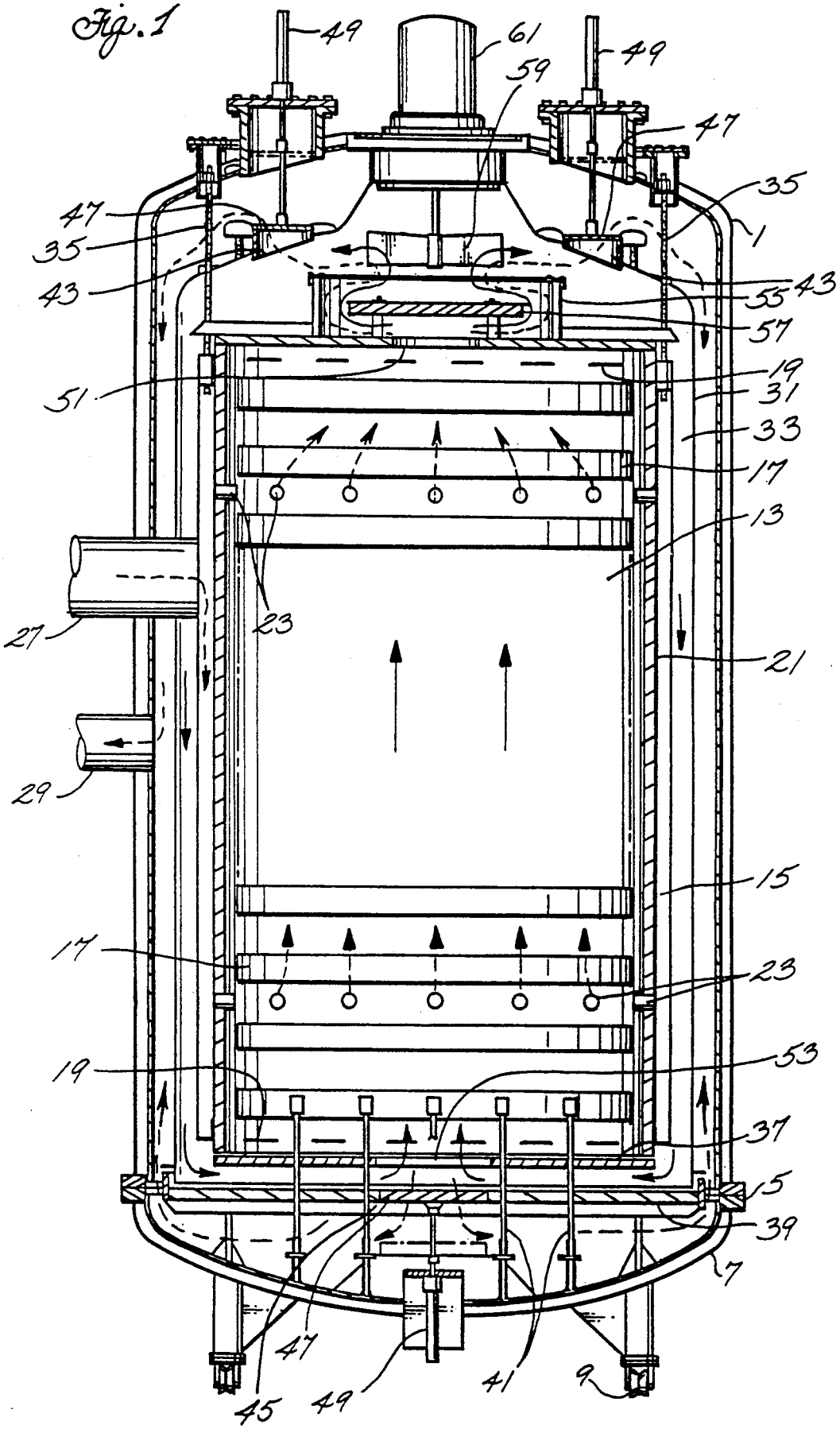
FIG. 1 is a longitudinal cross-section of a furnace showing the hot zone and the heating gas circulation chamber. Solid arrows indicate gas flow during low temperature convection heating. Broken arrows indicate cooling gas flow during a cooling cycle.
Figure 2:
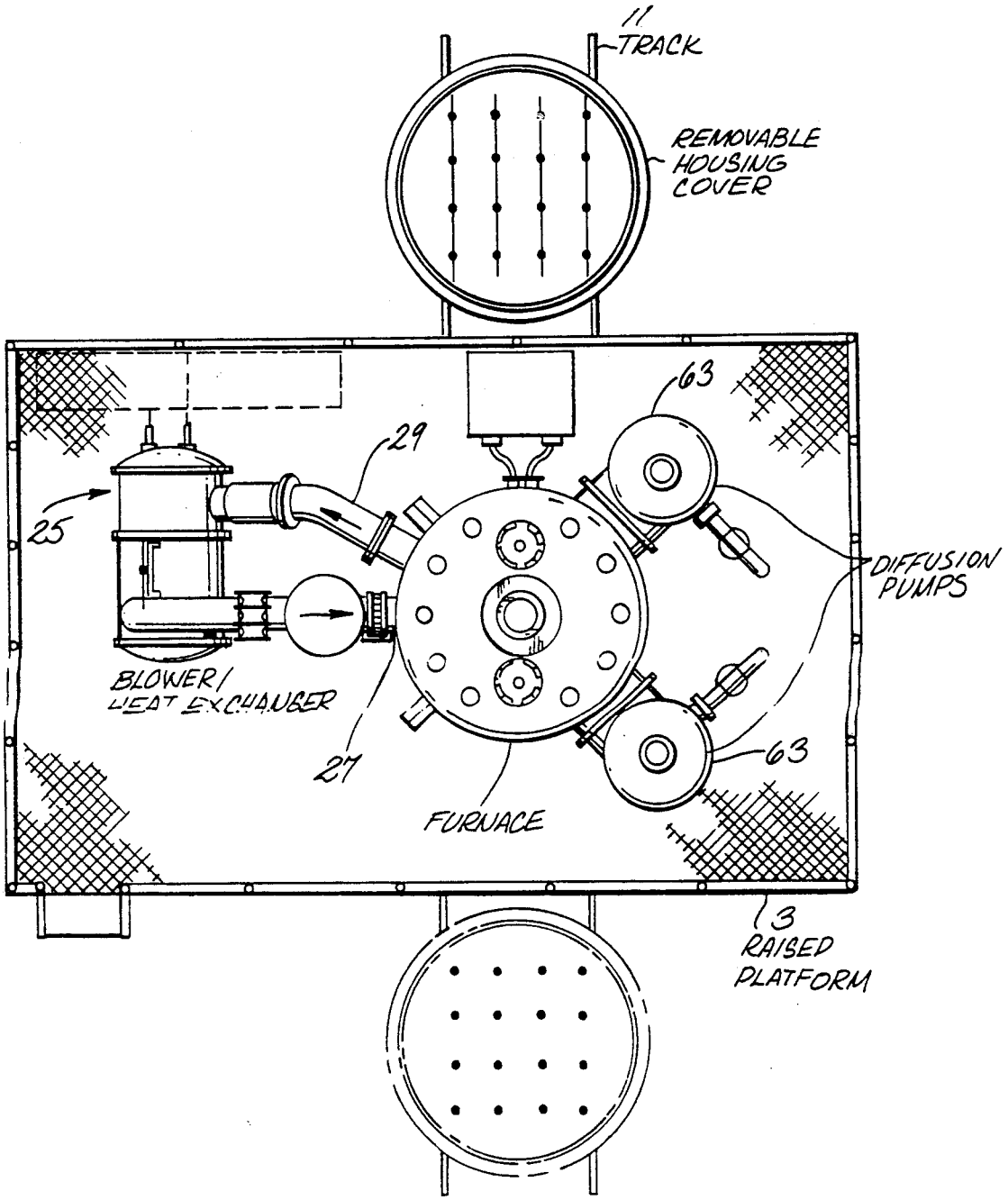
FIG. 2 is a top view showing the furnace connected to an external heat exchanger/blower and two diffusion pumps. The furnace is sitting on a raised platform.

In a preferred embodiment the furnace comprises a steel double walled, water cooled, vertical cylindrical furnace shell or housing 1 structurally supported on a raised platform 3. At the bottom end of the furnace housing is a sealing flange 5 against which a domed removable furnace base 7 is hermetically sealed to close the furnace. The furnace base has attached wheels 9 and can be lowered and conveniently rolled away from the raised platform on tracks 11 for easy introduction of a load (not shown) into the heating chamber.

Inside the furnace housing and conforming to its general shape and contour is a heating chamber suitably suspended from the top of the furnace housing by conventional mechanical structures 35. The heating chamber defines a hot zone 13 within which parts are disposed for thermal treatment. In a typical embodiment, the hot zone is surrounded by a double walled sheet metal cooling gas introduction chamber 15 into which cooling gas can be introduced for rapid cooling of the hot zone and its contents. Inwardly from the cooling gas introduction chamber is a layer (or layers) of thermal insulation 21 which may be in the form of a plurality of parallel metal radiation shields, fibrous ceramic insulating "wool", graphite "wool", or ceramic or graphite insulating sheets. Regardless of the types of insulation surrounding the hot zone, the innermost face is typically formed of sheet metal or flexible graphite sheet (Grafoil) which may be bonded to other materials. Such high temperature thermal insulation is conventional and need not be further described for an understanding of this invention.

A plurality of sheet-like electrical heater elements 17 extend circumferentially around the interior of the hot zone. Elements can also be arranged vertically. Elements can be made of metal or graphite. In the embodiment illustrated, only exemplary heater elements are shown schematically. In reality, the heater elements extend over the entire length of the hot zone and additional flat sheet heater elements 19 are positioned at the top and bottom of the hot zone. Each heater element is mechanically supported between its ends by a plurality of supporting assemblies, such as those described and illustrated in U.S Pat. No. 4,771,166.

The cooling gas introduction chamber extending the entire length of the hot zone forms a cylindrical chamber around the insulation wall 21 of the hot zone. The insulation wall is perforated by gas nozzles 23 (only a few are shown) evenly spaced between the heater elements for introducing cooling gas from the cooling gas introduction chamber into the hot zone during a cooling cycle. The cooling gas introduction chamber receives cold gas from an external conventional heat exchanger and blower 25 through an intake pipe 27. The cooling gas eventually leaves the hot zone and returns to the heat exchanger through a return pipe 29.

A coaxial metallic convection shroud 31, conforming to the general shape of the furnace housing, encloses the hot zone and its surrounding cooling gas introduction chamber in such a way as to form a space in between referred to as the heating gas circulation chamber 33. The convection shroud, made of stainless steel with graphite insulation material, is suspended structurally from the top of the furnace housing, sharing the same anchoring mechanism 35 with the heating chamber. Both the heating chamber and the convection shroud have removable bottoms 37 and 39 affixed to and movable with the removable furnace base 7. Attached to the inside wall of the removable furnace base and extending through the two removable bottoms 37 and 39 are a plurality of supporting rods 41 forming a grid structure for supporting the load (not shown) during heat treatment. The convection shroud has two top valve openings 43 and one bottom valve opening 45. Each opening can be closed or opened, thereby changing the gas flow passage, by a heat resistant bung 47 attached to the end of an air actuator rod 49 which, when extended closes the valve opening, and when retracted opens the valve opening. FIG. 1 shows the bungs (solid lines) in the closed position during the heating phase. The broken lines show the bungs in the open position during the cooling phase.

A top opening 51 and a bottom opening 53 are provided through the thermal insulation walls of the heating chamber and centrally located at the top and bottom of the heating chamber walls respectively. The top opening opens into a small chamber 55 which in turn opens at the top into the heating gas circulation chamber. A thermal shield 57 made of the same insulation material as the hot zone wall and slightly larger than the top opening 51 is anchored above the top opening 51 inside the small chamber in such a way that inert gas (nitrogen, argon, helium or mixture of these gases with small quantities of hydrogen) can flow from the hot zone through the top opening into the small chamber, around the thermal shield and out into the heating gas circulation chamber.

A fan 59, made of heat resistant material such as stainless steel, is located inside the heating gas circulation chamber and just above the opening on top of the small chamber. It is driven by an electric motor 61 on the top of the furnace housing.

During lower temperature convection heating, the furnace is filled with inert gas which carries heat energy from the heater elements to all parts of the hot zone. The rotating fan improves circulation of the heated inert gas between the hot zone and the heating gas circulation chamber. The solid arrows in FIG. 1 indicate the direction of gas flow.

Convection heating carried out in this manner can accelerate the heating-up of the hot zone by about 30% and improve temperature uniformity. By way of example, a furnace without convection heating may require 60 minutes to reach a hot zone temperature of 1000° F. while it takes only 40 minutes for convection heating to reach the same temperature. Additionally heating by convection eliminates and/or minimizes distortion due to more uniform heat transfer.

After the hot zone has reached a specified temperature, about 1000° to 1100° F., for example, radiation becomes a reasonably efficient means of heat transfer. Consequently, the inert gas is pumped out by conventional diffusion pumps 63 and mechanical pumps (not shown) to create a vacuum inside the furnace. In this high temperature heating phase, the reflective surfaces and the high temperature insulation walls keep the radiant heat loss to a minimum and also the thermal shield 57 protects the fan from heat damage.

During the cooling cycle, the three bungs 47 are retracted by their respective air actuators 49 to open the two top valve openings 43 and the bottom valve opening 45 in the convection shroud so that the heating gas circulation chamber and furnace hot zone now open into the furnace housing. Inert Cooling gas, conveyed by an external blower 25, enters the cooling gas introduction chamber 15 via the intake pipe 27 and is ejected towards the load through the gas nozzles 23. The broken arrow lines show the warmed cooling gas leaving the hot zone through the top and bottom openings, and passing through the three valve openings in the convection shroud and out of the furnace via the return pipe back to the external heat exchanger 25.

In the illustrated embodiment, a vertical cylindrical furnace is used. It will be apparent that the convection shroud concept is applicable to any type and shape of furnaces employing the two stage heating method.

What is claimed is:

1. A high temperature vacuum furnace comprising:

a cold furnace shell;

means for evacuating the furnace shell;

high temperature electric heater elements supported within the furnace shell defining a hot zone within which parts being heated are positioned;

high temperature insulation surrounding the hot zone;

a cooling gas introduction chamber surrounding the high temperature insulation and comprising nozzles located between the cooling gas introduction chamber and the hot zone;

a heating gas circulation chamber surrounding the cooling gas introduction chamber and having an opening to the hot zone at each end;

means for circulating heating gas from the hot zone through the heating gas circulation chamber and back into the hot zone;

a cooling gas circulation chamber surrounding the heating gas circulation chamber and adjacent to the cold furnace shell;

means for introducing a cooling gas into the cooling gas introduction chamber;

means for withdrawing cooling gas from the cooling gas circulation chamber; and means for introducing parts into the hot zone.

2. A high temperature vacuum furnace as recited in claim 1 comprising a plurality of movable heat resistant bungs between the heating gas circulation chamber and cooling gas circulation chamber for preventing gas flow therebetween during heating and permitting gas flow therebetween during cooling.

3. A high temperature vacuum furnace as recited in claim 1 wherein the furnace shell comprises a cylinder, the hot zone comprises a cylindrical volume concentric with the furnace shell and the means for circulating heating gas comprises means for circulating gas from one end of said hot zone to the other end of said hot zone.

4. A high temperature vacuum furnace as recited in claim 3 wherein the cooling gas introduction chamber is cylindrical and comprises nozzles for introducing cooling gas into a side of the hot zone and further comprising means for circulating cooling gas from each end of the cylindrical hot zone.

5. A high temperature vacuum furnace as recited in claim 1 wherein the heater elements comprise metal sheets surrounding sides of the hot zone and spaced apart from the high temperature insulation, and the nozzles between the cooling gas introduction chamber and the hot zone are spaced between heater elements.

6. A high temperature vacuum furnace as recited in claim 1 wherein said means for circulating heating gas from the hot zone through the heating gas circulation chamber and back into the hot zone comprises a motor with a heat resistance fan blade inside the heating gas circulation chamber and protected from intense heat during vacuum heating by a thermal shield.

7. A high temperature vacuum furnace as recited in claim 1 wherein the heating gas circulation chamber is formed by a metallic cylindrical convection shroud concentric with the furnace shell.

8. A high temperature vacuum furnace as recited in claim 7 wherein the metallic cylindrical convection shroud comprises a removable end for introducing parts into the hot zone and a plurality of openings on said cylindrical convection shroud, and further comprising movable heat resistant bungs for selectively opening and closing the openings.

9. A high temperature vacuum furnaces as recited in claim 8 wherein said each movable heat resistant bung is attached to an end of an air actuator rod which when extended causes the bung to close the opening and when retracted causes the bung to open the opening.

10. A high temperature vacuum furnace comprising:

a furnace shell;

electric heater elements surrounding the hot zone;

thermal insulation surrounding the hot zone;

means for supporting parts within the hot zone for heating and controlled cooling;

means outside the thermal insulation surrounding the hot zone for introducing cooling gas uniformly through the thermal insulation surrounding the hot zone during at least a portion of a furnace cooling cycle;

means for circulating heating gas through the hot zone and around an outside surface of the means for introducing cooling gas during at least an initial portion of a furnace heating cycle; and means for circulating a cooling gas from the hot zone and through a cooling gas circulation chamber surrounding the means for circulating heating gas and adjacent to the furnace shell during a furnace cooling cycle.

11. A furnace as recited in claim 10 wherein the means for circulating heating gas comprises a shroud surrounding the means for introducing cooling gas and spaced apart from the furnace shell.

12. A furnace as recited in claim 11 further comprising:

openings between the shroud and the space between the shroud and the furnace shell; and means for closing the openings during a furnace heating cycle and means for opening the openings during a furnace cooling cycle.

13. A high temperature vacuum furnace comprising:

a furnace shell;

means for introducing inert gas into the furnace and means for evacuating the furnace;

high temperature insulation forming an enclosure within the furnace shell with a high temperature heat source supported therein for defining a hot zone within which parts being heated are positioned;

means for injecting cooling inert gas uniformly into the hot zone during a furnace cooling cycle;

means for circulating heating inert gas along a path through the hot zone and around an outside surface of the means for injecting cooling gas during at least a portion of a furnace heating cycle;

means for circulating cooling inert gas from the hot zone, around the means for circulating heating inert gas and adjacent to the furnace shell during a furnace cooling cycle; and means for altering the path during a cooling cycle for causing cooling gas to circulate through the hot zone and out of the furnace shell.

14. A furnace as recited in claim 13 wherein the means for introducing and injecting cooling inert gas into the hot zone comprises a cooling gas introduction chamber surrounding the high temperature insulation enclosure and a plurality of nozzles extending through the side of the high temperature insulation between the cooling gas introduction chamber and the hot zone.

15. A furnace as recited in claim 14 wherein the means for circulating heating inert gas around the hot zone comprises a shroud surrounding the hot zone and the cooling gas introduction chamber.

16. A furnace as recited in claim 15 wherein the means for altering the path during a cooling cycle comprises selectively means for opening a plurality of bung openings on the shroud so that cooling gas injected from the cooling gas introduction chamber into the hot zone circulates out of the ends of the hot zone, through the bung openings on a shroud into the space between the shroud and the furnace shell, and through a heat exchanger and back to the cooling gas introduction chamber.

17. A high temperature vacuum furnace comprising:

a cylindrical water-cooled furnace shell;

a water-cooled removable end on the shell for introducing and removing articles to be heated and cooled within the vacuum furnace;

a cylinder of high temperature thermal insulation supported within the shell;

a plurality of electric heater elements supported within the high temperature thermal insulation for defining a cylindrical hot zone within which articles are heated and cooled;

a cooling gas introduction chamber around the outside of the cylindrical thermal insulation;

a plurality of nozzles extending through a side of the thermal insulation between the cooling gas introduction chamber and the hot zone for introducing cooling gas into the hot zone during a furnace cooling cycle;

an opening at each end of the hot zone for removing heated gas from the hot zone;

means for circulating heated gas from the hot zone through a heat exchanger for cooling the heated gas and introducing the cooled gas into the introduction chamber;

a cylindrical convection shroud surrounding the cooling gas introduction chamber;

means for circulating a heating gas from one end of the cylindrical hot zone through the convection shroud and back into the hot zone at the opposite end;

bung openings through the convection shroud at each end;

means for selectively closing the bung openings during a furnace heating cycle so that heating gas circulates through the hot zone from end to end and through the convection shroud, and for selectively opening the bung openings during a furnace cooling cycle so that cooling gas circulates into the side of the hot zone through the nozzles, out of the ends of the hot zone, between the convection shroud and the furnace shell for cooling by the furnace shell, through a heat exchanger and back into the introduction chamber during a cooling cycle.

18. A furnace as recited in claim 17 wherein the means for circulating a heating gas comprises a heat resistant electric fan mounted at one end of the furnace for forcing a gas circulating through the hot zone and around the convection shroud.

19. A furnace as recited in claim 17 wherein the cylindrical water cooled furnace shell has a vertical axis, the bung openings comprise an opening through an upper end of the convection shroud and an opening through a lower end of the convection shroud, and each bung further comprises a heat resistant plug and an air actuator rod attached to the plug for extension to close the opening or retraction to open the opening.

* * * * *